US012352071B2

(12) United States Patent
Barton et al.

(10) Patent No.: US 12,352,071 B2
(45) Date of Patent: Jul. 8, 2025

(54) INLINE DISPENSING SYSTEM

(71) Applicant: King Technology Inc., Minnetonka, MN (US)

(72) Inventors: Eric Barton, Eden Prairie, MN (US); Jeffrey D Johnson, Edina, MN (US); Darrin M Swagel, Minnetonka, MN (US)

(73) Assignee: King Technology, Inc., Minnetonka, MN (US)

( * ) Notice: Subject to any disclaimer, the term of this patent is extended or adjusted under 35 U.S.C. 154(b) by 0 days.

(21) Appl. No.: 17/941,507

(22) Filed: Sep. 9, 2022

(65) Prior Publication Data

US 2023/0081353 A1 Mar. 16, 2023

Related U.S. Application Data

(60) Provisional application No. 63/360,217, filed on Sep. 14, 2021.

(51) Int. Cl.
*E04H 4/12* (2006.01)

(52) U.S. Cl.
CPC ..... *E04H 4/1281* (2013.01)

(58) Field of Classification Search
CPC . E04H 4/1281; E04H 4/12; C02F 1/68; C02F 2201/006; B01D 35/00
USPC ..... 4/541.3, 507, 509, 559, 490, 286, 4/DIG. 10; 210/752, 167.1, 167.11, 205
See application file for complete search history.

(56) References Cited

U.S. PATENT DOCUMENTS

| | | | | |
|---|---|---|---|---|
| 5,526,956 | A | 6/1996 | Osgar | |
| 5,743,287 | A | 4/1998 | Rauchwerger | |
| 7,238,280 | B1 * | 7/2007 | King | C02F 1/688 210/205 |
| 9,101,888 | B2 | 8/2015 | King et al. | |
| 2010/0219203 | A1 | 9/2010 | King | |
| 2017/0015472 | A1 | 1/2017 | King et al. | |
| 2017/0167641 | A1 | 6/2017 | Daly et al. | |
| 2020/0122064 | A1 | 4/2020 | Söderström et al. | |

OTHER PUBLICATIONS

International Patent Application No. PCT/US2022/043052, International Search Report and Written Opinion mailed Feb. 8, 2023, 11 pages.

* cited by examiner

*Primary Examiner* — Tuan N Nguyen
(74) *Attorney, Agent, or Firm* — Fredrikson & Byron, P.A.

(57) ABSTRACT

An inline dispensing system having a collar engageable with an inline well to support an inline cap thereon and for directing a cartridge carrier into a sealing relation therewith as a cartridge carrier is inserted into an inline well in a container of a body of recreational water.

10 Claims, 9 Drawing Sheets

FIG. 4
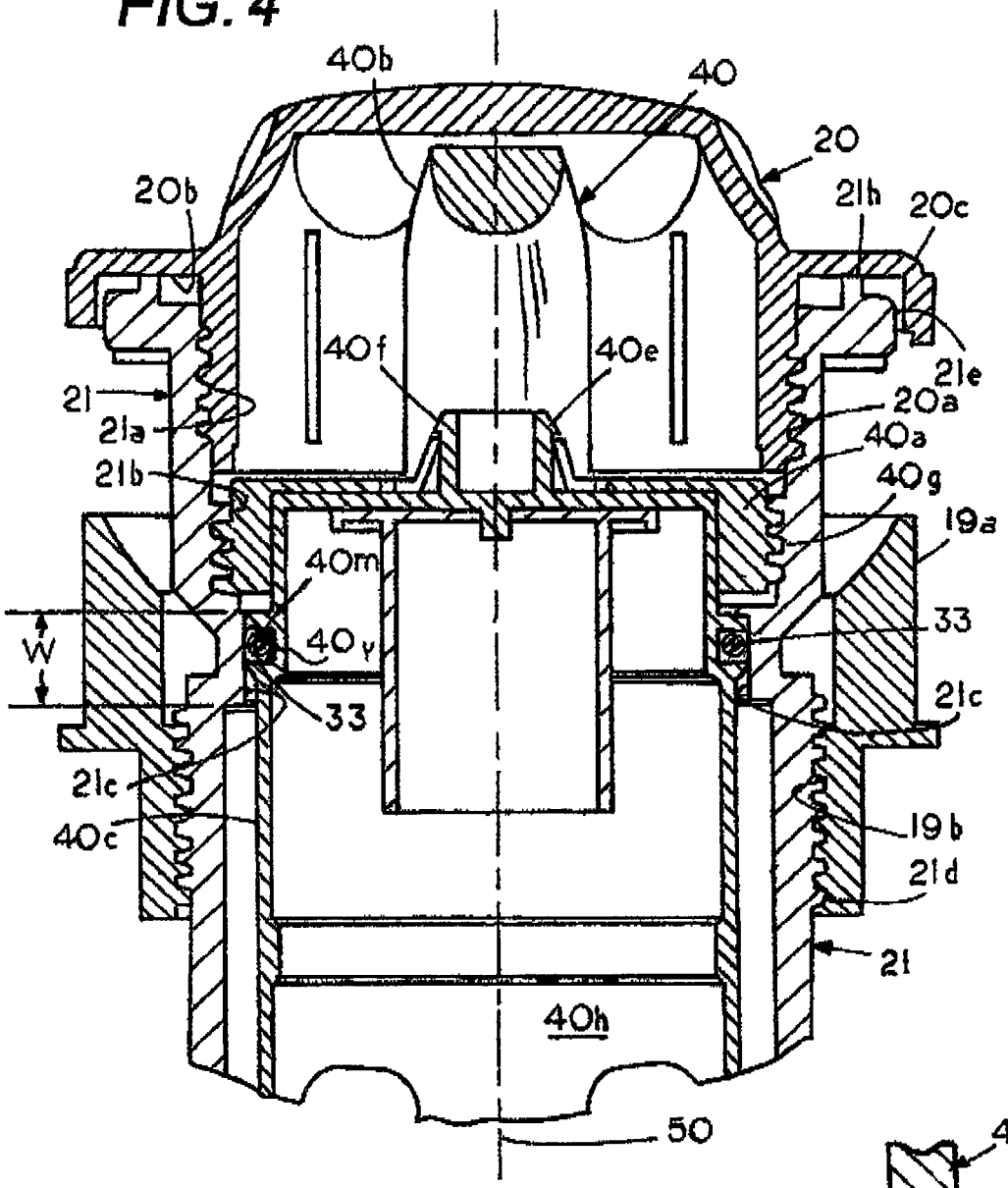
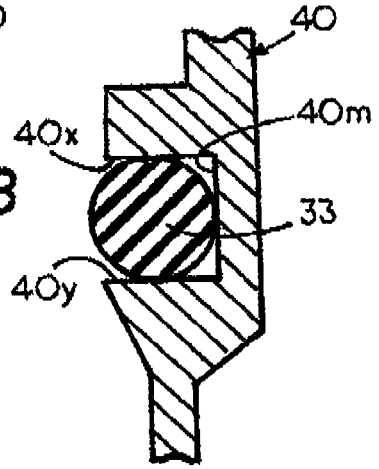
FIG. 4B

INLINE DISPENSING SYSTEM

CROSS REFERENCE TO RELATED APPLICATIONS

This application contains priority from provisional application Ser. 63/360,217; filed Sep. 14, 1921.

STATEMENT REGARDING FEDERALLY SPONSORED RESEARCH OR DEVELOPMENT

None

REFERENCE TO A MICROFICHE APPENDIX

None

BACKGROUND OF THE INVENTION

The use of inline systems to deliver dispersants into a body of water such as a hot tub is shown in King U.S. Pat. Nos. 6,328,900; 7,052,615 and 7,883,623. Typically, inline system dispensers are contained in a dispenser housing with the dispensers containing dispersants that are delivered into the body of water as water flows past the dispensers, which are located in axial alignment in an elongated housing. In one example, a cartridge carrier, which contains cartridge dispensers, is inserted into a well in the hot tub. Once the cartridge carrier is inserted into the inline well, one rotates a cap on the hot tub that brings the threads on the cap and the threads on the inline well into sealing engagement to prevent leakage therebetween. From time to time, such action may cause a problem in removing the cap for replacement of a dispensing cartridge. For example, if the cap is overtightened, or if temperature changes occur in the cap and well it may make it difficult to remove the cap and replace dispensers in the cartridge carrier.

SUMMARY OF THE INVENTION

An inline well with a multithreaded collar including a first set of threads engageable with an inline well cap and a second set of threads engageable with a cartridge carrier. In one embodiment, a well cap is rotatably engageable with the first set of threads and a cartridge carrier is rotatably engageable with the second set of threads to axially displace a seal on the cartridge carrier into a sealing engagement with the multithreaded collar.

BRIEF DESCRIPTION OF THE DRAWINGS

FIG. 4 is a sectional view of a cartridge carrier, a multithreaded collar, and an inline well cap in engagement with each other along a central axis;

FIG. 4B is an isolated view of a sealing ring carried in a circular channel in a cartridge carrier;

DESCRIPTION OF THE PREFERRED EMBODIMENT

Figure 1:
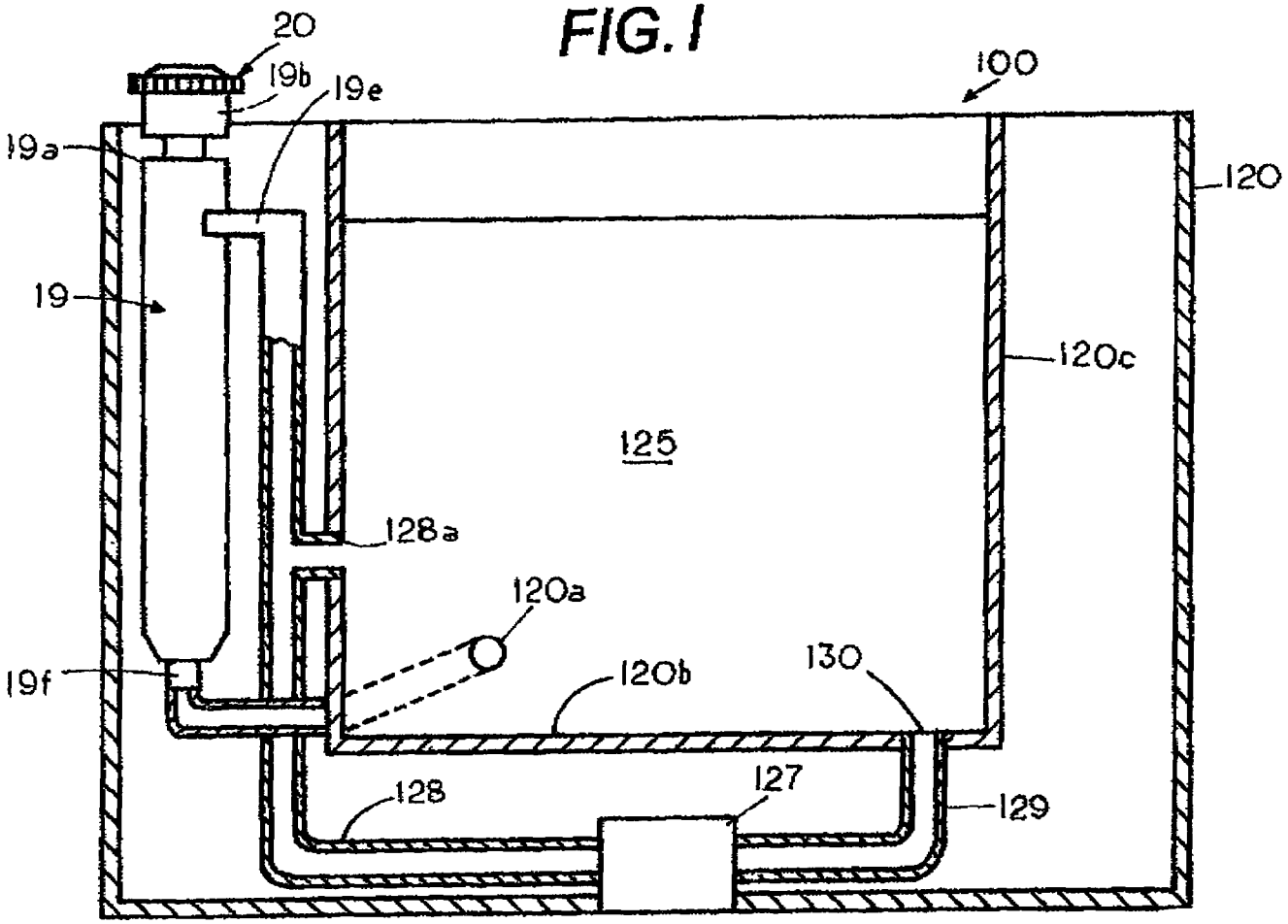
FIG. 1 shows a hot tub with an inline well for dispensing dispersant into a body of recreational water.

FIG. 1 is a cutaway view showing a recreational water system 100 with an outer housing 120 having an inner container 120*c*, which is partially filled with a fluid, such as water 125. Typically, system 100 can be in a pool, a hot tub or the like where a fluid treatment is required to maintain the water in a user-friendly condition. For example, the system can be used for treating water that may be used either for work, pleasure or for drinking. In the embodiment shown container 120*c* is configured in a hot tub mode with a seating area 120*b*, an inlet 130 positioned to draw water into an inlet pipe 129 through a pump 127. Pump 127 increases the pressure of the water and forces the water through a fluid conduit 128 on the outlet side of the pump 127 where a portion of the water discharges through underwater port 128*a* as a high-pressure fluid jet. The high-pressure fluid jet provides multiple functions, for example, in a hot tub, the high-pressure fluid jet produced by the pump 127 circulates the water 125 in the hot tub thus ensuring that water purification materials in the hot tub are dispersed throughout the hot tub. In addition, the high-pressure jet can also provide a water massage to a user sitting in the hot tub.

Typically, the downstream velocity of the high-pressure jet that enters inline well housing 19 through inlet 19*e* is decreased through an orifice or restriction, which reduces the velocity of the water flowing through dispersants that are in a chamber in inline well housing 19. Water, which enters inline well housing 19 through inlet 19*e* typically flows through a cartridge dispenser where dispersants therein are carried into the main body of water 125 through outlet 19*f* and port 120*a*.

Figure 2:
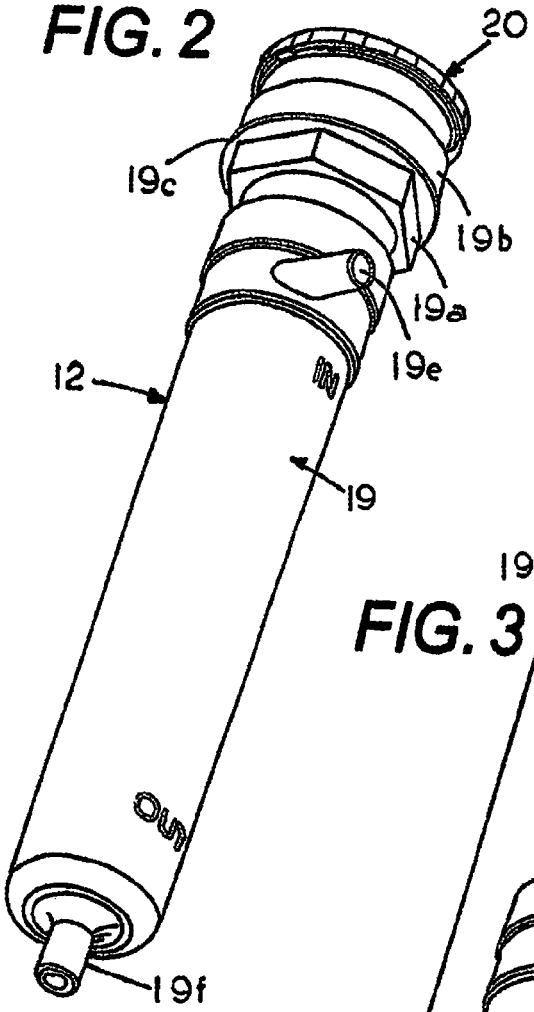
FIG. 2 is an isolated perspective view of the inline well and an inline cap in engagement with each other.
Figure 10:
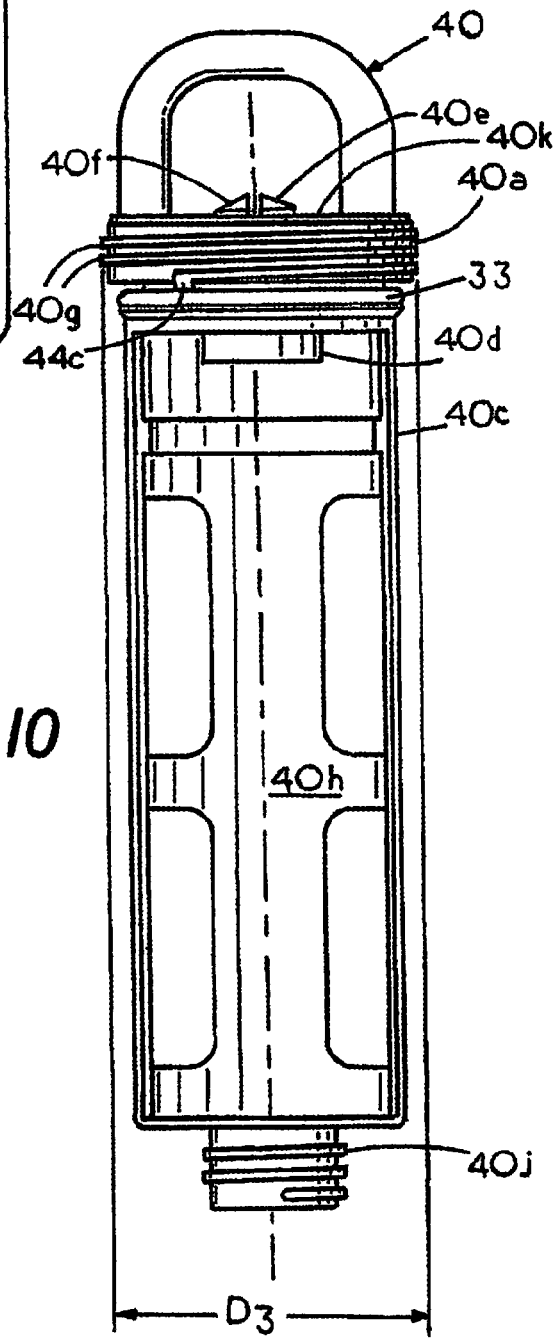
FIG. 10 is an isolated view of a cartridge carrier with a rotatable hub and a skeleton housing of the cartridge carrier having a compartment for inserting a cartridge dispenser therein with the cartridge carrier include an end connector for securing a second cartridge dispenser thereto.

FIG. 2 shows an example of an inline well 12 that is placeable in a hot tub with the inline well having a water inlet 19*e* on one end and a water outlet 19*f* on the opposite end of housing 19. Typically, a cartridge carrier such as shown in FIG. 10 is located therein. Inline well 12 includes a connector 19*a* and a washer 19*c* and sleeve 19*b* that can be used to secure inline well 12 to the frame of a hot tub or the like. A well cap 20 rotationally attaches to the top end of inline well 12.

Figure 3:
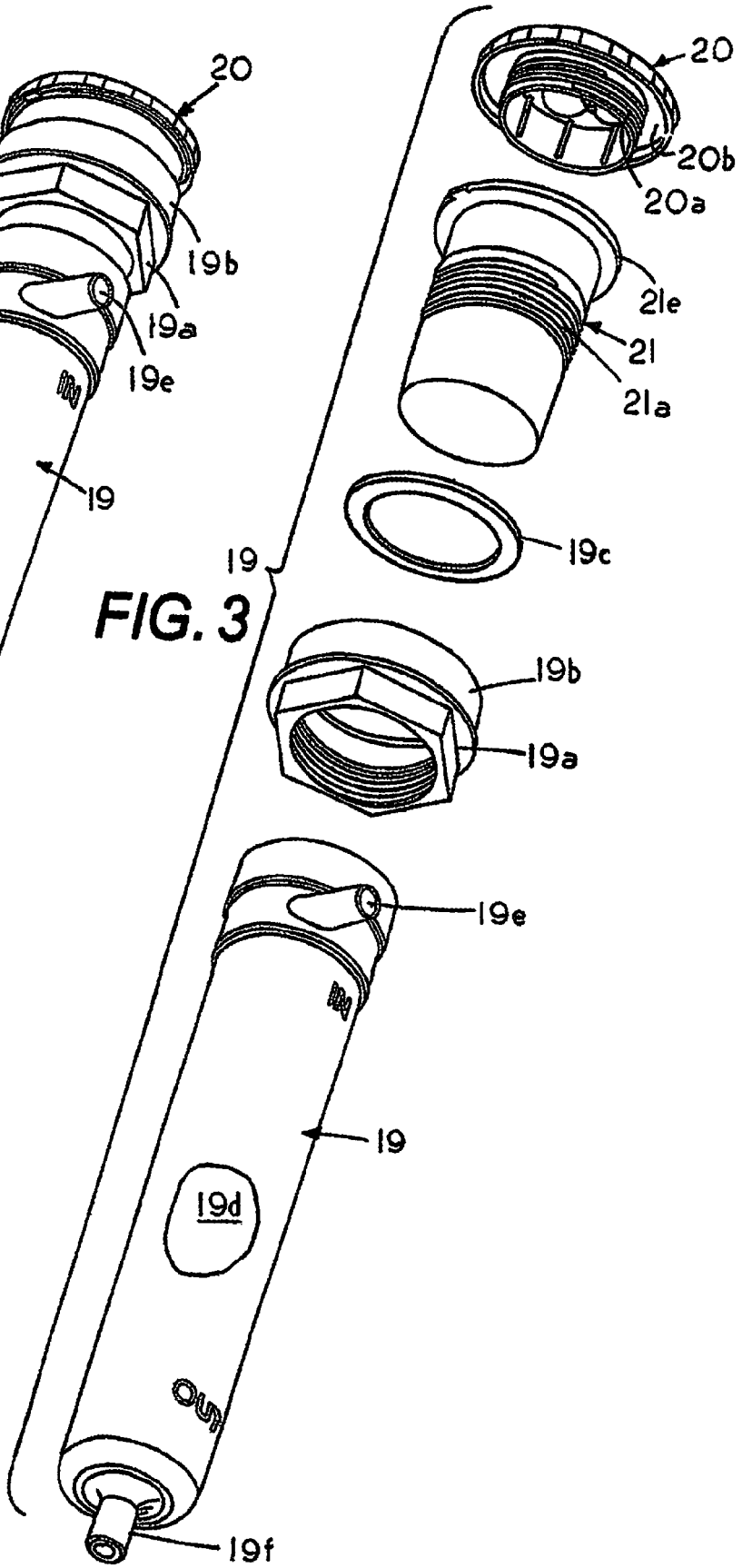
FIG. 3 is an exploded view of the inline well of FIG. 2.

FIG. 3 is an exploded view of the inline well of FIG. 2 showing inline well housing 19 partly in section to reveal a chamber 19*d* therein for supporting cartridge dispensers in a dispensing condition as water flows from inlet 19*e* to outlet 19*f*. Attached to the top end of housing 19 is a connector 19*a* having internal threads, a sleeve 19*b*, a washer 19*c*, and a multithreaded collar 21 with internal threads and external threads 21*a*. An inline well cap 20 with external threads 20*a* rotationally attaches to collar 21 to bring annular cap seat 20*b* into engagement with flange 21*e*. To replace a spent dispensing cartridge in the inline well housing 19 one removes well cap 20 from multithreaded collar 21 through an opposite rotation of inline well cap 20.

FIG. 4 is a sectional assembled view of a top end of inline well 12 revealing the multithreaded collar 21 having a set of external threads 21*d* and two sets of internal threads, a first set 21*a* and a second smaller set 21*b*, which are concentrically positioned with respect to each other along a central axis 50.

Figure 4A:
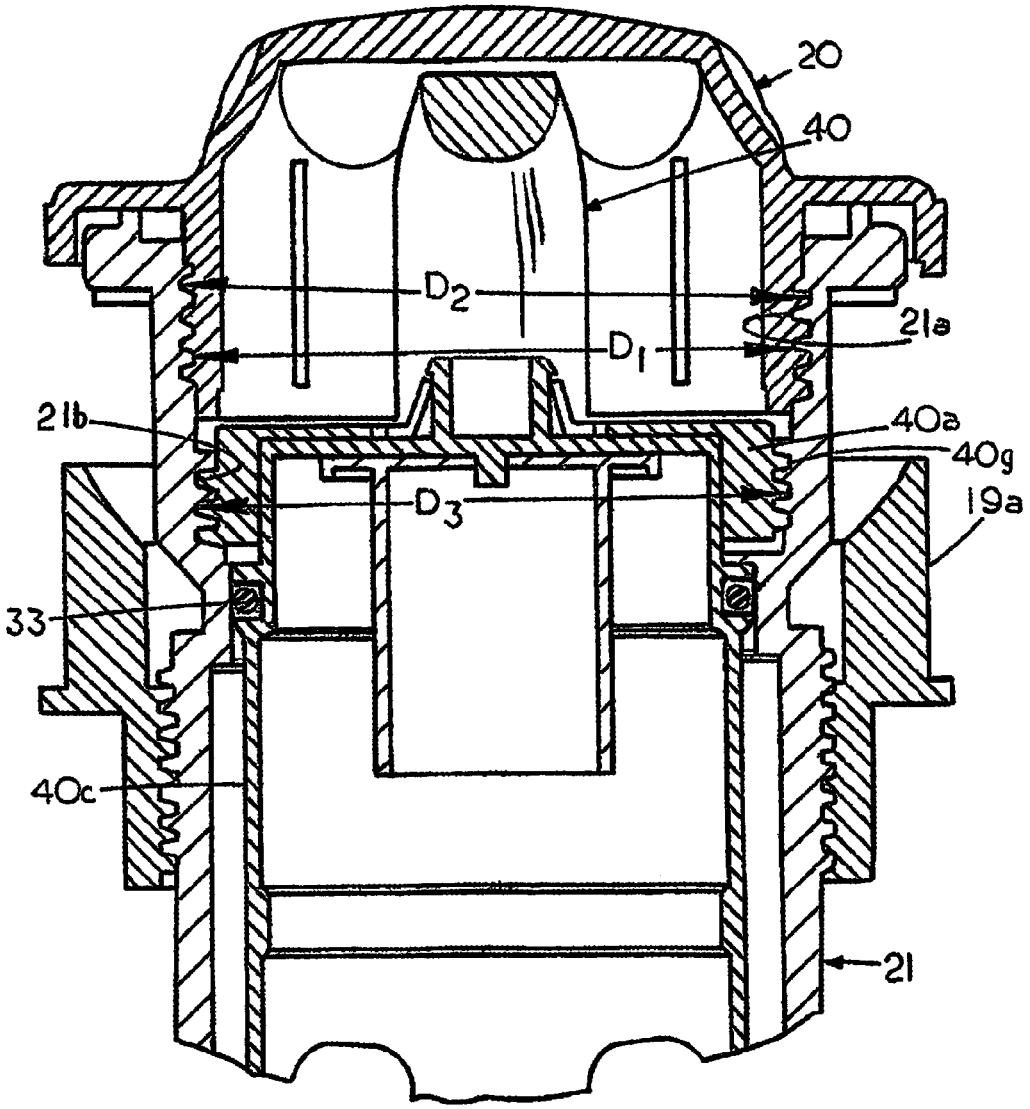
FIG. 4A is a sectional view of the multithreaded collar of FIG. 4 with thread diameter designations of the multiple threads in the multithreaded inline collar.
Figure 5:
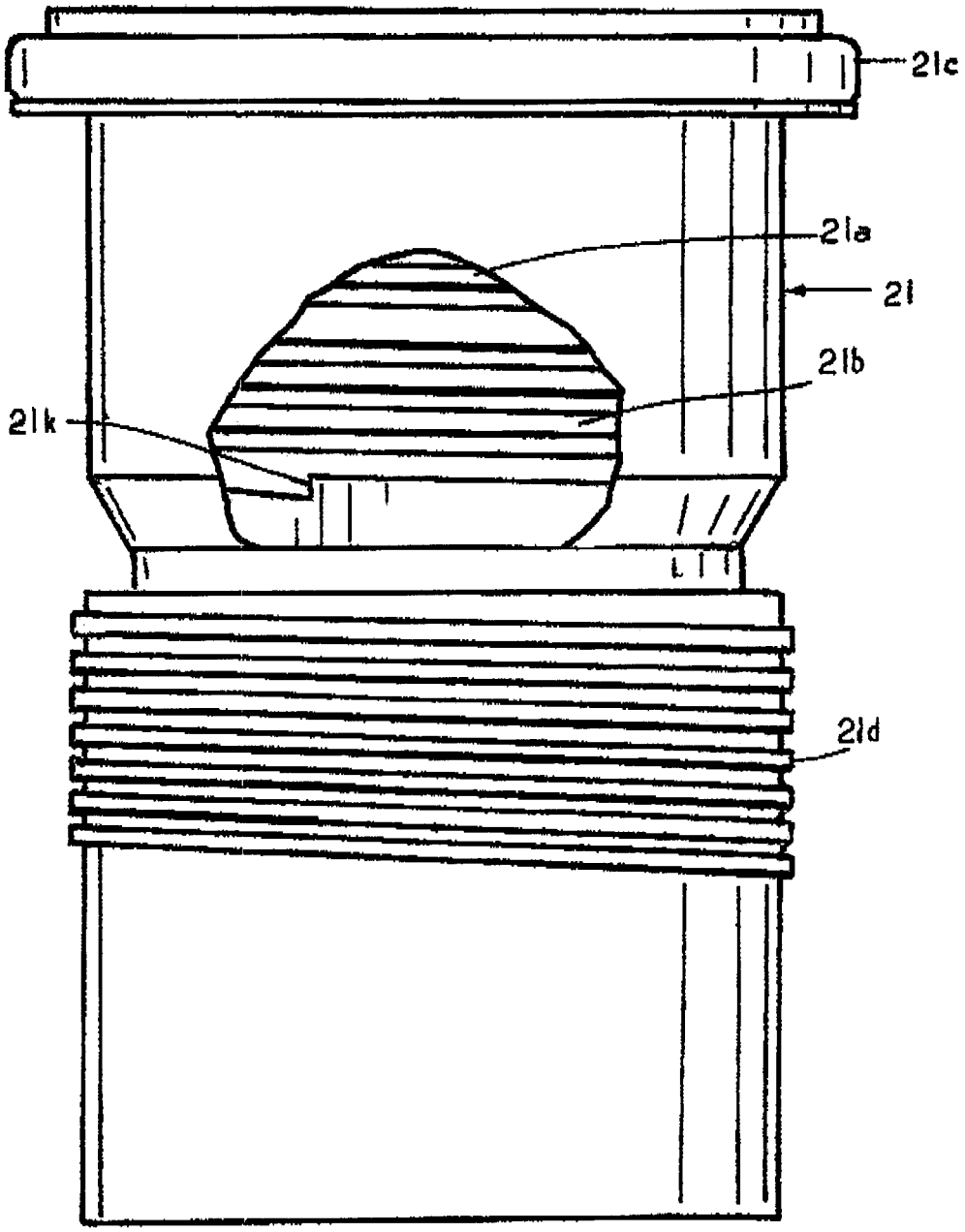
FIG. 5 is an isolated view of a portion of the multithreaded inline collar to reveal a cartridge carrier hub stop in the inline collar.

FIG. 4 shows an inline cap 20 in engagement with the first set of threads 21*a* and a rotatable cartridge carrier 40 in engagement with a second set of smaller threads 21*b* while FIG. 5 shows an isolated view of an example of a multithreaded collar 21 and FIG. 10 is an isolated view of an example of a rotatable cartridge carrier 40 for engagement with the multithread collar 21.

FIG. 4A shows the tooth and crown dimensions of collar 21 comprising a first set of internal threads 21*a* in multithreaded collar 21 having a diametrical crown to crown distance $D_1$ and a diametrical root to root distance $D_2$. FIG. 4A also shows a second set of internal threads 21*b* in collar 21 where a diametrical root to root distance $D_3$ is less than the diametrical crown to crown distance $D_1$ of the first set of female threads 21*a*. The relative dimensional sizing permits axial insertion and threaded engagement of cartridge carrier hub 40*a* past the first set of threads 21*a* and into mating engagement with the second set of male threads 21*b*, which has a diametrical crown to crown distance $D_3$, which is less than either the diametrical crown distance $D_1$ or root to root distance $D_2$. Thus, in this example multithreaded collar 21 includes a first set of internal threads 21*a* having the larger internal diameter threads proximate a top end of collar 21 with the second set of smaller diameter internal threads 21*b* located within the collar 21 and proximate the annular sealing surface 21*c*. The aforesaid thread arrangement allows cartridge carrier hub 40 to be axially inserted into threaded engagement with the smaller diameter internal threads 21*b* located within multithreaded collar 21 without engaging the first set of internal threads 21*a*.

FIG. 4B is an isolated view from FIG. 4 showing a top channel wall 40*x* on one side of sealing ring 33 and a lower channel wall 40*y* on the opposite side of sealing ring 33 connected with channel wall 40*m* with the channel walls cooperating to axially restrain sealing ring 33 therein as the sealing ring 33 is axially displaced into sealing engagement against annular sealing surface 21*c* through rotation of cartridge carrier hub 40*a*. That is external male hub threads 40*g* rotationally engage collar threads 21*b* to bring sealing ring 33 on cartridge carrier 40 into a sealing relationship with the annular sealing surface 21*c* on multithreaded collar 21.

In the example shown the first set of internal threads 21*a* on collar 21 form threaded engagement with a set of external threads 20*a* on well cap 20 to maintain well cap 20 thereon and a second set of internal threads 21*b* on collar 21 form threaded engagement with a set of external hub threads 40*g* on hub 40*a* to support cartridge carrier 40 thereon.

FIG. 4 and FIG. 4A show that when cartridge carrier hub 40*a* is in threaded engagement with collar threads 21*b*, it prevents axial displacement of hub 40*a* with respect to collar 21. Consequently, sealing ring 33 sealingly engages annular sealing surface 21*c* on collar 21 to maintain a water seal even when inline cap 20 is removed since cap 20 and cartridge carrier hub 40*a* are independently attached to collar 21 through separate sets of external threads. Thus, a feature of the invention is that with the present invention cap 20 can be removed from collar 21 without breaking the water seal formed between sealing ring 33 on cartridge carrier 40 and annular sealing surface 21*c* on collar 21. FIG. 4A illustrates the dimensional relationship that enables hub 40*a* to engage threads 21*b* but not threads 21*a*.

In the invention described herein rotational action of hub 40*a* is needed to insert or remove cartridge carrier 40 from collar 21. Consequently, sealing ring 33 remains in a sealing condition with sealing surface 21*c* until such rotational action is initiated. That is, to remove cartridge carrier 40 one grasps cartridge carrier handle 40*b* and rotates cartridge carrier hub threads 40*g* in a first direction that axially displaces hub 40*a* and breaks the seal formed between sealing surface 21*c* and sealing ring 33.

In contrast, to form the seal between sealing ring 33 and sealing surface 21*c* one rotates the cartridge carrier hub threads 40*g* in an opposite direction to axially displace the hub 30 into sealing engagement with sealing surface 21*c*.

FIG. 5 shows an isolated sectional view of an interior of the multithreaded collar 21 revealing a first set of large diameter ($D_2$) internal threads 21*a* and the second set of smaller diameter ($D_3$) internal threads 21*b* and a hub stop 21*k* locate below threads 21*b* that limits rotation of cartridge carrier hub 40*a* and hence the axial displacement of cartridge carrier 40.

In this example a set of external threads 21*d* on collar 21 enable mounting the multithreaded collar 21 to a frame of a hot tub; however, other types of fasteners may be used without departing from the spirit and scope of the invention.

Figure 6:
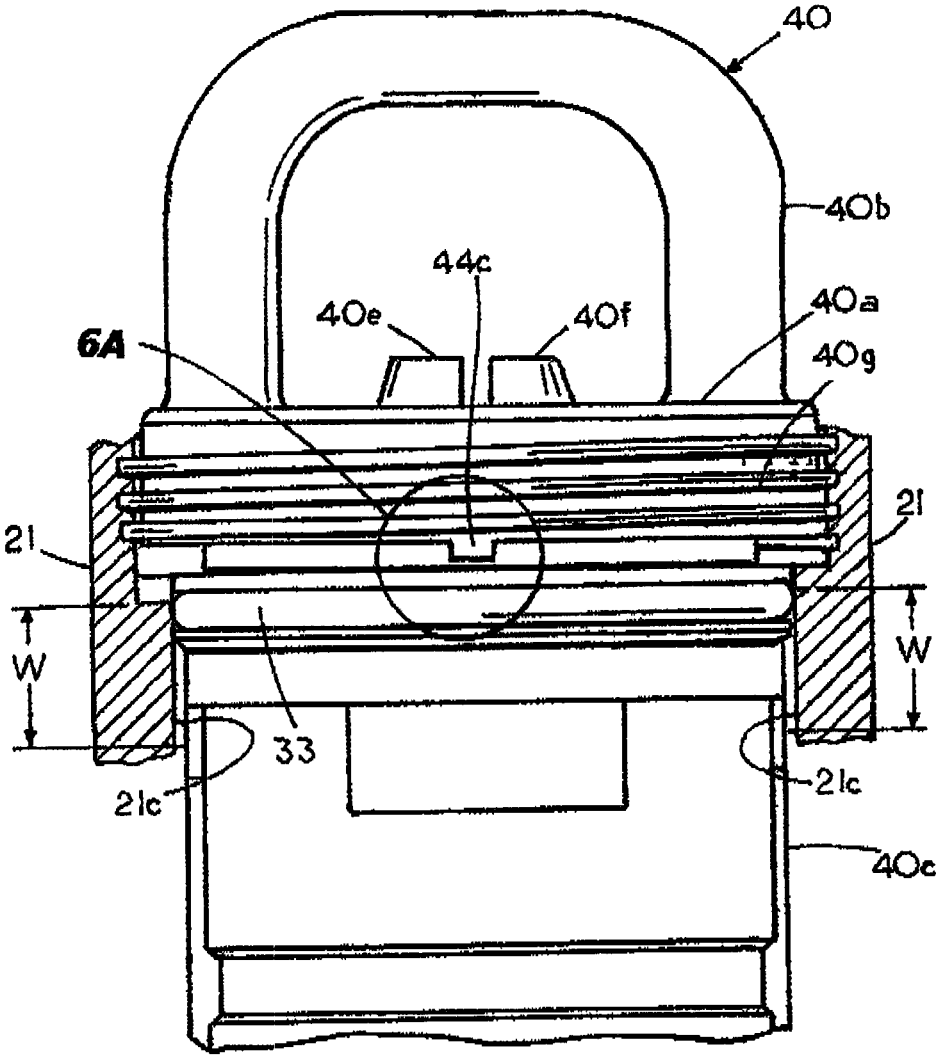
FIG. 6 is a partial view of a cartridge carrier and a multithreaded inline collar showing a rotatable hub of the cartridge carrier in engagement with a portion of the multithreaded inline collar prior to axially displacing the cartridge carrier into sealing engagement with the multithreaded inline collar.

FIG. 6 is a partial view of cartridge carrier 40 and a partial view of multithreaded collar 21 showing an extension 44*c* on hub 40*a* that rotates with hub 40*a*. That is, if one grasps cartridge carrier handle 40*b* one can rotate hub 40*a* with respect to collar 21 to axially displace sealing ring 33 into sealing engagement with annular sealing surface 21*c*. Note, FIG. 6 shows the sealing ring 33 at a top end of annular sealing surface 21*c*. That is, cartridge carrier hub 40*a* has begun the axial downward displacement of sealing ring 33 into sealing engagement with annular sealing surface 21*c* on collar 21. Further displacement of sealing ring 33 (through rotation of hub 37) enables one to obtain a sealing relationship between sealing ring 33 and annular sealing surface 21*c*, which is also shown in FIG. 4 and FIG. 4A. Once the sealing relationship between the cartridge carrier 40 and the multithreaded collar 21 is obtained the rotation of hub 40 is stopped by an extension or stop 44*c* thereon.

Figure 6A:
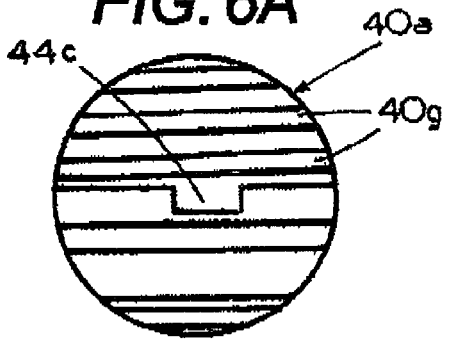
FIG. 6A is an isolated view of a stop on the cartridge carrier hub.

FIG. 6A is an isolated view from FIG. 6 that reveals extension 44*c* and male threads 40*g* located on cartridge carrier hub 40*a*.

Figure 7:
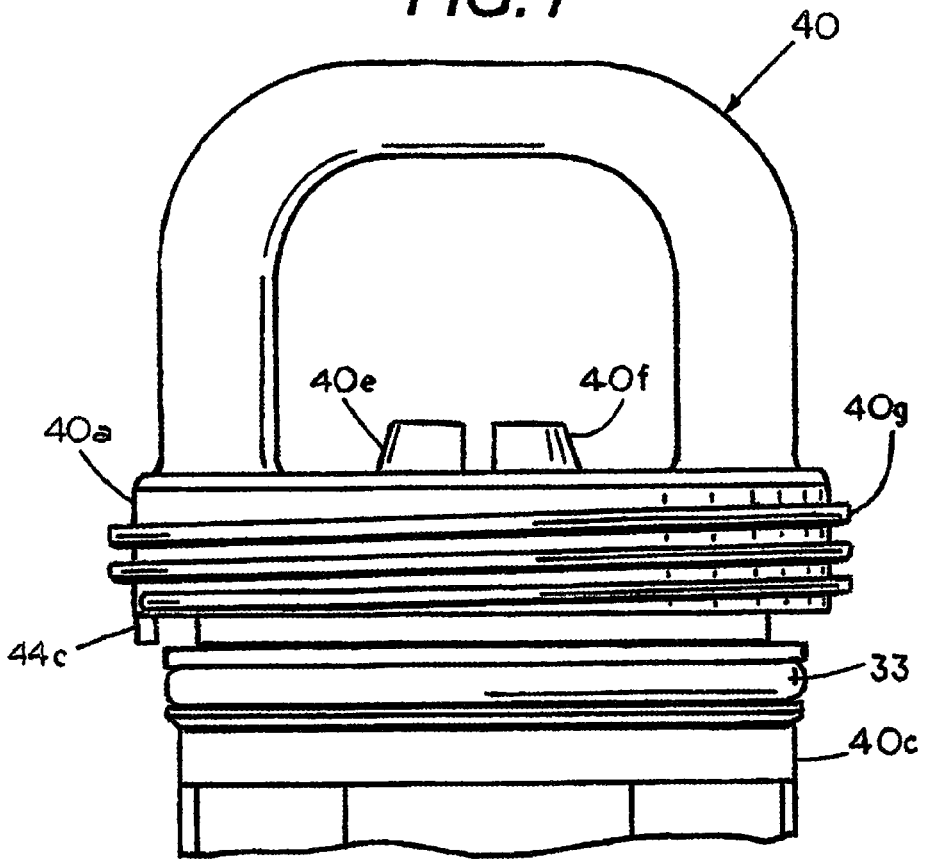
FIG. 7 is a partial view of the rotatable hub of a cartridge carrier with an extension located on the cartridge carrier hub for limiting a downward axially displacement of the sealing ring by preventing further rotation of the hub.
Figure 9:
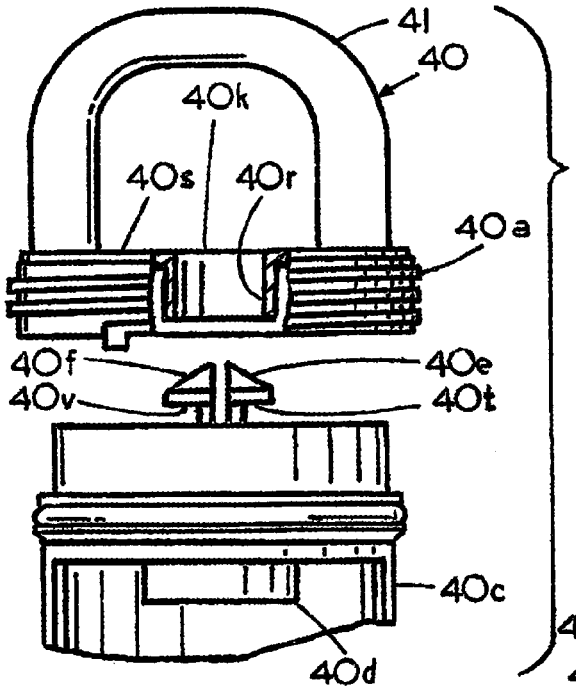
FIG. 9 is an exploded view, partially in section showing a set of resilient hooks on the top of a cartridge carrier skeleton housing that allows the handle and hub of the cartridge carrier to rotate independently of the cartridge carrier skeleton housing.

FIG. 7 is an isolated view of cartridge carrier 40 and cartridge carrier hub 40*a*, which is rotatable with respect to cartridge carrier skeleton housing 40*c* through a first resilient hook 40*e* and second resilient hook 40*f*, which are attached to the top end of skeleton housing 40. FIG. 9 is an exploded view of the rotatable hub 40*a* and the cartridge carrier skeleton housing 40*c* of FIG. 7 showing resilient hook 40*e* and resilient hook 40*f* in a position to be axially inserted into hub 40*a* for rotatably attachment with cartridge carrier skeleton housing top surface 40*s*.

FIG. 7 also shows cartridge carrier 40 with an external thread 40*g* with an extension 44*c*, which comprises a rotational stop, that limits rotation of hub 40*a* and thus stops axial displacement of sealing ring 33 with respect to annular sealing surface 21*c*.

Figure 8:
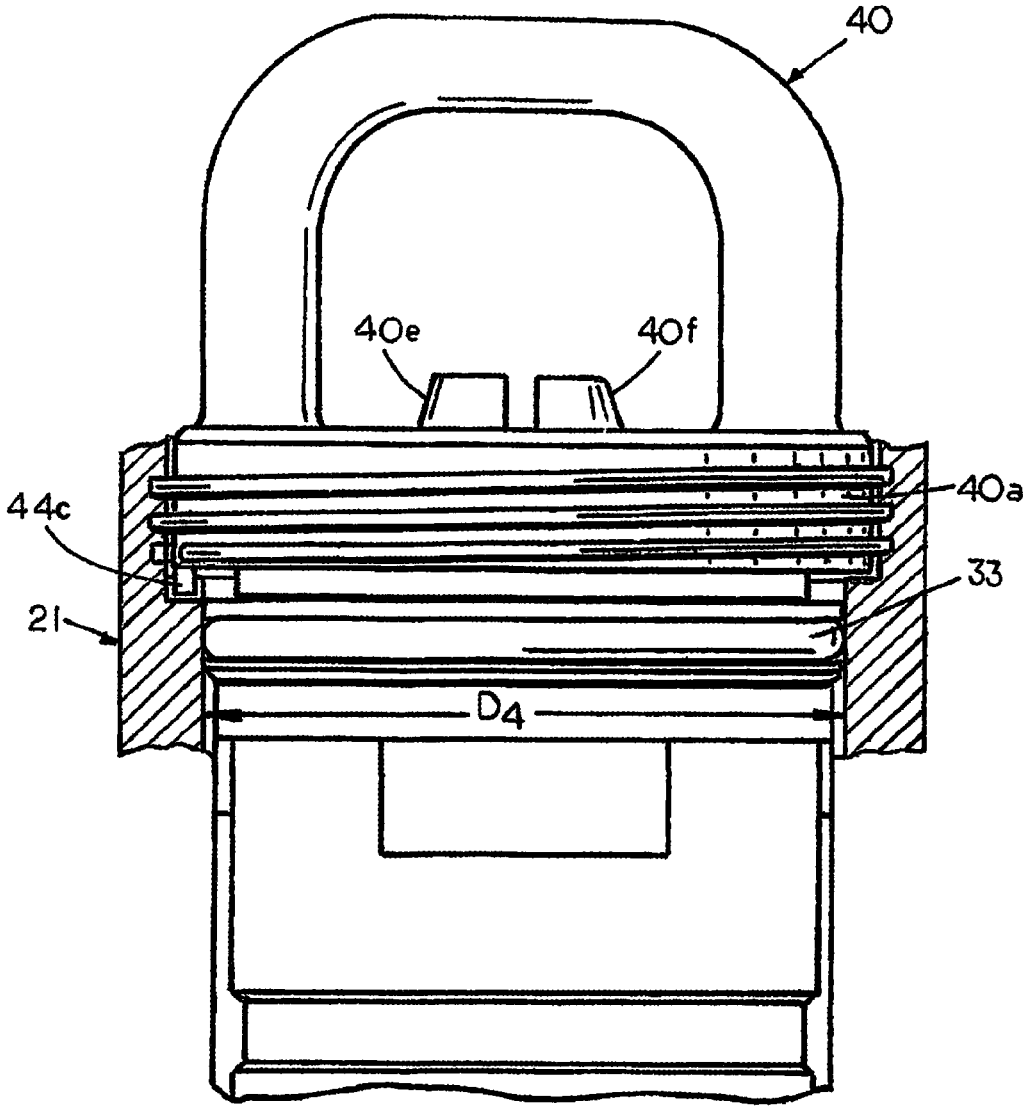
FIG. 8 is a partial view of the cartridge carrier and the multithreaded inline collar showing the rotatable hub of the cartridge carrier in sealing engagement with an annular sealing region on the multithreaded inline collar.
Figure 8A:
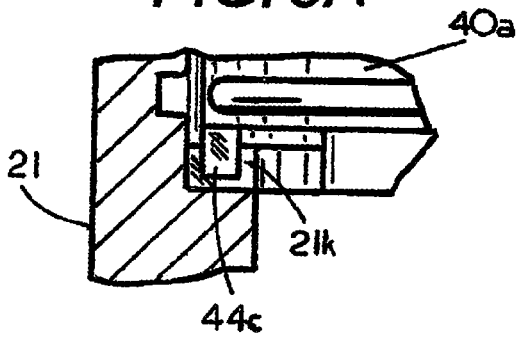
FIG. 8A is an isolated view showing the extension on the cartridge carrier hub and a stop on the multithreaded inline collar in engagement with each other to prevent further rotation of the cartridge carrier hub with respect to the multithreaded inline collar.

FIG. 8 shows sealing ring 33 fully engaged with annular sealing surface 21*c* thus ensuring an effective seal therebetween and FIG. 8A is an isolated view showing extension 44*c* on hub 40*a* in engagement with stop 21*k* to prevent further rotation of the hub 40*a*.

A further feature of the invention is illustrated in FIG. 8A, namely that rotation of hub 40*a* with handle 40*b* axially displaces sealing ring 33 into a proper sealing condition with sealing surface 21*c*. Once the sealing ring is in the proper sealing condition a stop 21*k* on collar 21 engages an extension 44*c* that prevents further rotation of hub 40*a*.

FIG. 9 and FIG. 10 show an example of cartridge carrier 40 with a hub 40*a* that is rotatable with respect to the skeleton housing 40*c* with FIG. 10 showing an assembled view of cartridge carrier hub 40*a* and skeleton housing 40*c* and FIG. 9 showing an exploded view of cartridge carrier hub 40*a* and skeleton housing 40*c*. FIG. 9 shows a set of resilient latches 40*e* and 40*f*, which are formed in the shape of hooks, that extend axially upward from a top surface of skeleton housing 40*c*. Latch 40*e* includes a bearing surface 40*t* and latch 40*f* also includes a bearing surface 40*v* which can rotatable engage bearing surface 40*s* on hub 40*a* when the resilient latches are extended through the central opening 40*k* in hub 40*a*. That is, latches 40*e* and 40*f* flex radial inward for insertion through central opening 40*k* having a sidewall 40*r* that forms a lateral bearing surface. Once the latches are inserted though opening 40*k* the underside 40*v* of hook 40*f* and the underside 40*t* of hook 40*e* engage a top bearing surface 40*s* on hub 40*a* with sufficient clearance that the cartridge carrier hub 40*a* can be rotated with respect to skeleton housing 40*c* by grasping and rotating handle 41 about a central axis of the skeleton housing 40*c*.

The example shown in FIG. 10 includes a cartridge carrier 40 having an interior chamber 40*h* for holding a first cartridge dispenser therein and a threaded end connector 40*j* for attaching a second cartridge dispenser thereto. Although a cartridge carrier for holding two cartridge dispensers is shown more or fewer cartridge dispensers may be attached to cartridge carrier hub 40*a* without departing from the spirit and scope of the invention.

We claim:

1. An inline well for delivery of a dispersant to a body of recreational water comprising:

a housing having a dispensing chamber with a water inlet and a water outlet;

a collar located in said housing, the collar including an annular sealing surface extending along an internal surface of the collar;

a first set of internal threads in said collar, said first set of internal threads having a diametrical crown to crown distance ($D_1$) and a diametrical root to root distance ($D_2$);

a second set of internal threads in said collar having a diametrical root to root distance ($D_3$) that is less than the diametrical crown to crown distance ($D_1$); and a cartridge carrier positioned within the collar, the cartridge carrier including:

a hub having a set of external threads with a diametrical crown to crown distance ($D_3$) that is less than the diametrical crown distance ($D_1$), to permit axial insertion and threaded engagement with the second set of internal threads, and a housing for supporting a cartridge dispenser, an outer surface of the hub having a sealing ring sized for engagement with the annular sealing surface, rotation of the hub relative to the collar with the hub engaged with the second set of internal threads moves the hub and the housing axially within the collar and displaces the sealing ring into sealing engagement with the annular sealing surface, the hub being rotatable independent of the housing, whereby rotation of the hub does not necessitate rotation of the housing.

2. The inline well of claim 1 wherein the first set of internal threads comprises a set of inline well cap threads.

3. The inline well of claim 2 where the collar includes a cap engaging flange.

4. The inline well of claim 3 including an inline end cap having an external flange engageable with the cap engaging flange.

5. The inline well of claim 1 wherein the set of external threads of the hub are engageable with the second set of internal threads but not the first set of internal threads to support the cartridge carrier thereon.

6. The inline well of claim 1 wherein the collar includes an external thread.

7. The inline well of claim 1 where the annular sealing surface has a diametrical distance which is less than diametrical root to root distance ($D_3$).

8. The inline well of claim 1, wherein the sealing ring is located in a circumferential channel on the cartridge carrier hub.

9. The inline well of claim 1 wherein the cartridge carrier hub includes a handle to aid in rotation of the cartridge carrier hub with respect to the cartridge carrier housing.

10. The inline well of claim 1 where the inline well includes an extension and the cartridge carrier includes a stop that prevents rotation of the hub when the sealing ring is located in a sealing relationship with the annular sealing surface on the collar.

* * * * *